US009936843B2

(12) United States Patent
Marsden et al.

(10) Patent No.: US 9,936,843 B2
(45) Date of Patent: Apr. 10, 2018

(54) COMBINATION FOOTSTOOL AND CHILD POTTY

(71) Applicant: DOREL JUVENILE GROUP, INC., Foxboro, MA (US)

(72) Inventors: Andrew W Marsden, Hingham, MA (US); Lynn Pina, Mansfield, MA (US)

(73) Assignee: Dorel Juvenile Group, Inc., Foxboro, MA (US)

( * ) Notice: Subject to any disclaimer, the term of this patent is extended or adjusted under 35 U.S.C. 154(b) by 120 days.

(21) Appl. No.: 14/496,502

(22) Filed: Sep. 25, 2014

(65) Prior Publication Data

US 2015/0082532 A1 Mar. 26, 2015

Related U.S. Application Data

(60) Provisional application No. 61/882,266, filed on Sep. 25, 2013.

(51) Int. Cl.
*A47K 11/06* (2006.01)

(52) U.S. Cl.
CPC ..... *A47K 11/06* (2013.01)

(58) Field of Classification Search
CPC ..... B65D 25/22; B65D 25/24; B65D 25/204; B65D 25/0234; A47K 11/06; A47K 13/06
USPC ..... 4/483, 479, 902
See application file for complete search history.

(56) References Cited

U.S. PATENT DOCUMENTS 522,163 A 6/1894 Johnson
551,100 A 12/1895 Scattergood
D45,221 S 2/1914 Biever
1,163,263 A 12/1915 Rudduck
1,196,427 A 8/1916 Brandenburg
1,281,763 A 10/1918 Carre
1,701,115 A 2/1929 McKinney, Jr.
1,739,001 A 12/1929 Lang
1,739,366 A 12/1929 Lang
2,050,114 A 8/1936 Moore
2,155,577 A 4/1939 Zaio
2,219,643 A 10/1940 Zaio
2,431,538 A 11/1947 Brief et al.
2,712,653 A 9/1950 Nika et al.
D168,463 S 7/1952 Hue
2,692,992 A 11/1954 Thimmes et al.
2,820,969 A 1/1958 Wedge
3,142,847 A 8/1964 Kurrels
3,205,510 A 9/1965 Levine
3,210,777 A 10/1965 Katoch
3,343,179 A 9/1967 Sellars, Jr. et al.
3,715,549 A 2/1973 Kraff
3,860,970 A 1/1975 Thompson
3,949,432 A 4/1976 Ginsburg
3,983,582 A 10/1976 Morris et al.
4,091,473 A 5/1978 Matthews et al.
4,213,211 A 7/1980 Bemis et al.
4,461,046 A 7/1984 Adams
4,516,279 A 5/1985 Block
4,517,689 A 5/1985 Smith et al.
D282,964 S 3/1986 Bepristis
(Continued)

*Primary Examiner* — Erin Deery

(74) *Attorney, Agent, or Firm* — Barnes & Thornburg LLP

(57) ABSTRACT

A child potty includes an elevated seat pad for seating a child and a waste collector associated with the seat pad. A platform can lie above the child potty to elevate a child above a floor underlying the child potty.

21 Claims, 5 Drawing Sheets

(56) References Cited

U.S. PATENT DOCUMENTS

| | | | | | |
|---|---|---|---|---|---|
| 4,736,472 | A | | 4/1988 | Buckshaw et al. | |
| 4,777,672 | A | | 10/1988 | Gebhard et al. | |
| 4,795,056 | A | * | 1/1989 | Meyers | B65D 50/045 215/321 |
| 4,807,308 | A | * | 2/1989 | Person | A47K 11/06 4/483 |
| 4,815,361 | A | | 3/1989 | Chiarella | |
| 4,842,330 | A | | 6/1989 | Jay | |
| D305,357 | S | | 1/1990 | Ritzer | |
| 4,894,870 | A | | 1/1990 | Buckshaw et al. | |
| D307,629 | S | | 5/1990 | Takahashi et al. | |
| D309,176 | S | | 7/1990 | Sessions | |
| 5,136,731 | A | | 8/1992 | Caro et al. | |
| 5,161,263 | A | | 11/1992 | Geneve et al. | |
| 5,172,431 | A | | 12/1992 | Rohde | |
| 5,182,818 | A | | 2/1993 | Nawoj | |
| 5,255,934 | A | | 10/1993 | Wilson | |
| D345,414 | S | | 3/1994 | Douglas | |
| 5,289,596 | A | | 3/1994 | Rose et al. | |
| D346,206 | S | | 4/1994 | Crossley et al. | |
| D356,635 | S | | 3/1995 | Roth | |
| D356,860 | S | | 3/1995 | Bosje | |
| 5,432,956 | A | | 7/1995 | Park | |
| 5,448,781 | A | | 9/1995 | Miller | |
| D363,116 | S | | 10/1995 | Skoda et al. | |
| 5,457,833 | A | | 10/1995 | Jay | |
| 5,477,569 | A | * | 12/1995 | Porter | A47K 11/06 220/826 |
| 5,509,149 | A | | 4/1996 | Lynch | |
| 5,524,295 | A | | 7/1996 | Ford | |
| 5,535,456 | A | | 7/1996 | Chai | |
| 5,560,051 | A | | 10/1996 | Butts | |
| D375,544 | S | | 11/1996 | Nakata et al. | |
| D378,124 | S | | 2/1997 | Jordan | |
| D379,495 | S | | 5/1997 | Sidman et al. | |
| D381,070 | S | | 7/1997 | Deniakis et la. | |
| 5,685,029 | A | * | 11/1997 | Gee | A47K 11/06 4/239 |
| 5,778,460 | A | | 7/1998 | Doell et al. | |
| 5,842,234 | A | | 12/1998 | Dixon | |
| 5,842,235 | A | | 12/1998 | Miayzaki | |
| 5,916,664 | A | | 6/1999 | Rudy | |
| 5,978,976 | A | | 11/1999 | Chai | |
| 6,038,711 | A | * | 3/2000 | Clarke | A47K 11/04 4/449 |
| 6,052,840 | A | | 4/2000 | West et al. | |
| 6,067,666 | A | | 5/2000 | Dixon | |
| 6,081,943 | A | | 7/2000 | Garcete | |
| 6,112,339 | A | | 9/2000 | Nichols et al. | |
| 6,116,780 | A | | 9/2000 | Young et al. | |
| 6,341,386 | B1 | | 1/2002 | Phillips et al. | |
| D454,624 | S | | 3/2002 | Yeung | |
| 6,353,941 | B1 | | 3/2002 | Manning et al. | |
| 6,385,790 | B1 | | 5/2002 | Abraham et al. | |
| 6,698,036 | B2 | | 3/2004 | Armbruster et al. | |
| 6,701,539 | B1 | | 3/2004 | Hogan | |
| 6,782,565 | B2 | | 8/2004 | Hinton | |
| 7,150,050 | B2 | | 12/2006 | Sharp | |
| 7,290,296 | B1 | | 11/2007 | Wilson | |
| D556,875 | S | | 12/2007 | Zandren | |
| 7,334,273 | B2 | | 2/2008 | Thomas | |
| 7,770,242 | B2 | | 8/2010 | Sell | |
| 8,276,219 | B2 | * | 10/2012 | Dubiel | A47K 11/06 4/479 |
| D716,919 | S | * | 11/2014 | Yeung | D23/296 |
| 2007/0017015 | A1 | * | 1/2007 | Finell | A47K 11/06 4/483 |
| 2008/0086804 | A1 | | 4/2008 | Goh Aow | |
| 2008/0178379 | A1 | | 7/2008 | Davis | |
| 2008/0263756 | A1 | * | 10/2008 | Marsden | A47K 11/06 4/239 |
| 2011/0061157 | A1 | * | 3/2011 | Goergen | A47K 11/06 4/483 |
| 2011/0099706 | A1 | * | 5/2011 | Jenner | A47K 11/06 4/483 |
| 2011/0131718 | A1 | | 6/2011 | Smith | |
| 2011/0214228 | A1 | | 9/2011 | Rosser | |
| 2011/0314598 | A1 | | 12/2011 | Rathbone | |

* cited by examiner

COMBINATION FOOTSTOOL AND CHILD POTTY

PRIORITY CLAIM

This application claims priority under 35 U.S.C. § 119(e) to U.S. Provisional Application Ser. No. 61/882,266, filed Sep. 25, 2013, which is expressly incorporated by reference herein.

BACKGROUND

The present disclosure relates to a juvenile bathroom system. In particular, the present disclosure relates to juvenile potties and to step stools.

SUMMARY

A juvenile bathroom system in accordance with the present disclosure includes a child potty adapted to set on a floor away from a toilet so that it can be used easily by a young child during toilet training. In illustrative embodiments, the juvenile bathroom system further includes a footstool adapted to set on a floor and formed to include a downwardly opening potty-storage chamber that is sized to receive and store the child potty therein during use of the footstool to elevate a child above the floor.

In illustrative embodiments, the footstool includes a shell formed to include the downwardly opening potty-storage chamber. The shell includes a horizontal child-support platform and a downwardly extending platform-elevation side wall coupled to a perimeter edge of the child-support platform. A child can sit on and use the child potty during toilet training after the child potty has been removed from the potty-storage chamber by a caregiver and placed on the floor and the unused footstool that formerly held the child potty can be set aside. When not in use, the child potty can be stored in the potty-storage chamber formed in the shell without impeding the use of the footstool by a child or adult in a bathroom or elsewhere.

In illustrative embodiments, the shell included in the footstool can be made of a transparent material to allow a caregiver to see that a child potty has been stored in the potty-storage chamber formed in the shell while the footstool is arranged to lie in a ready-to-use position on a floor without first having to lift the footstool away from the floor and turn it over to look into the potty-storage chamber.

In illustrative embodiments, the footstool also includes a potty-retainer tab coupled to the shell and arranged to extend into a tab-receiver channel formed in the child potty when the child potty is deposited into the potty-storage chamber formed in the shell to retain the child potty in a stationary position on the footstool. The side wall of the shell includes an interior surface bounding the potty-storage chamber and surrounding a child potty stored therein. The potty-retainer tab is cantilevered to the interior surface of the side wall of the shell. The shell is made of an elastic deformable plastics material and a portion of the side wall is arranged to lie in spaced-apart relation to the child potty when the child potty is stored in the potty-storage chamber formed in the shell and the potty-retainer tab is arranged to extend into the tab-receiver channel to anchor the footstool to the stored child potty.

In illustrative embodiments, to release the footstool from the child potty, a caregiver applies a squeezing force to opposite front and rear portions of the shell side wall to cause deformation of that side portion of the shell side wall that carries the potty-retainer tab. This side-wall deformation is sufficient to cause the potty-retainer tab to move outwardly away from the child potty to a disengaged position that is withdrawn from the tab-receiver channel formed in the child potty to release the child potty from the footstool so that the footstool can be lifted upwardly leaving the juvenile potty in a stationary position on the floor.

In illustrative embodiments, the shell side wall includes a right side portion extending between the front and rear side portions and carrying a right-side potty-retainer tab and a left side portion also extending between the front and rear side portions to lie in laterally spaced-apart relation to the right side portion and carrying a left-side potty-retainer tab. When the caregiver applies a squeezing force to the front and rear side walls, the front side portion is moved inwardly toward the child potty and the shell side wall is deformed and changes shape to cause the left side and right side portions to move away from one another and from the child potty located therebetween to cause (1) a first potty-retainer tab cantilevered to the right side portion to disengage a companion first tab-receiver channel formed in one side of the child potty and to cause (2) a second potty-retainer tab coupled to the left side portion to disengage a companion second tab-receiver channel formed in a second side of the child potty to release the child potty so that it can be removed from the potty-storage chamber formed in the footstool.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
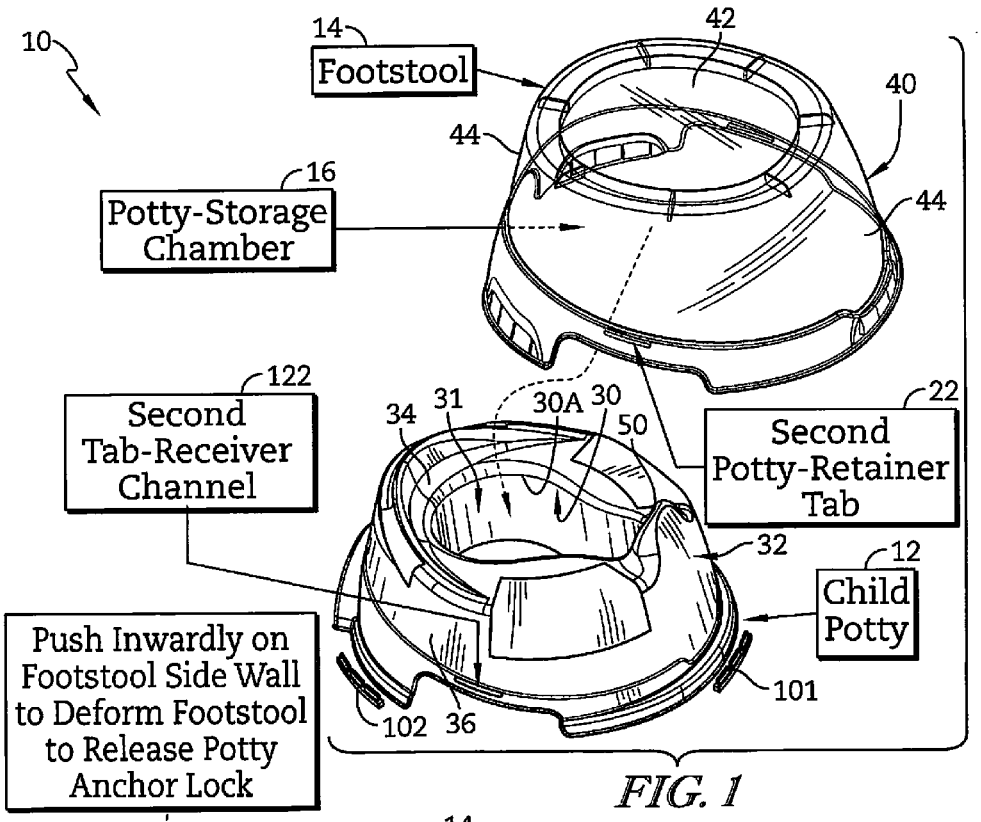
FIG. 1 is a perspective assembly view of an unassembled juvenile bathroom system comprising a footstool and a child potty having an elevated seat pad surrounding a top aperture opening into a waste-collection chamber and showing the footstool before it is mounted on the child potty as suggested in FIGS. 2 and 4 to locate the child potty in a downwardly opening potty-storage chamber formed in the footstool.

An illustrative juvenile bathroom system 10 includes a child potty 12 and a footstool 14 formed to include a downwardly opening potty-storage chamber 16 as suggested in FIG. 1. A child potty anchor lock 18 is provided in system 10 for retaining child potty 12 in a stationary position in potty-storage chamber 16 without impeding the use of footstool 14 by a child or adult in a bathroom or elsewhere as suggested in FIGS. 2 and 5.

Footstool 14 changes shape when squeezed in a certain way by a caregiver to unlock child potty anchor lock 18 as suggested in FIGS. 2 and 9-11 to free child potty 12 so that it can be removed from the potty-storage chamber 16 formed in footstool 14. For example, front and rear side portions 44F, 44R of footstool 14 can be squeezed as suggested in FIGS. 9 and 10 to unlock the child potty anchor lock 18 that is associated with left and right side portions of footstool 14 as suggested in FIG. 11 so that the caregiver can lift footstool 14 upwardly away from an underlying floor 20 to separate footstool 14 from the underlying child potty 12 and leave child potty 12 in place on the underlying floor 20.

Figure 4:
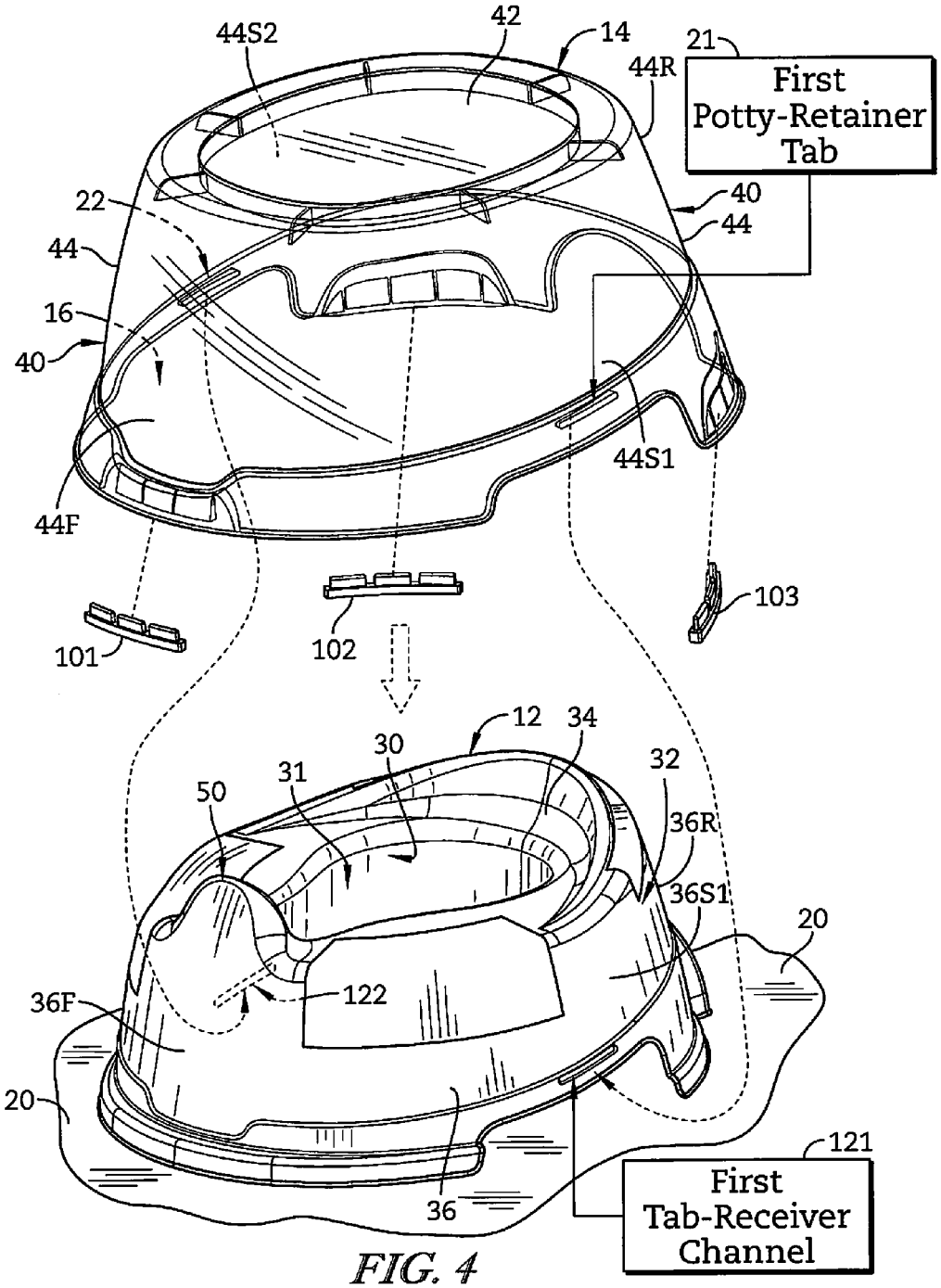
FIG. 4 is an enlarged exploded perspective view of the footstool and the child potty of FIGS. 1-3 showing that the footstool includes first and second inwardly extending potty-retainer tabs and suggesting that a first potty-retainer tab provided on a near side of the footstool shell is sized and shaped to extend into a companion first tab-receiver channel formed on a near side of the child potty and that a second potty-retainer tab provided on a far side of the footstool shell is sized and shaped to extend into a companion second tab-receiver channel formed on a far side of the child potty.
Figure 5:
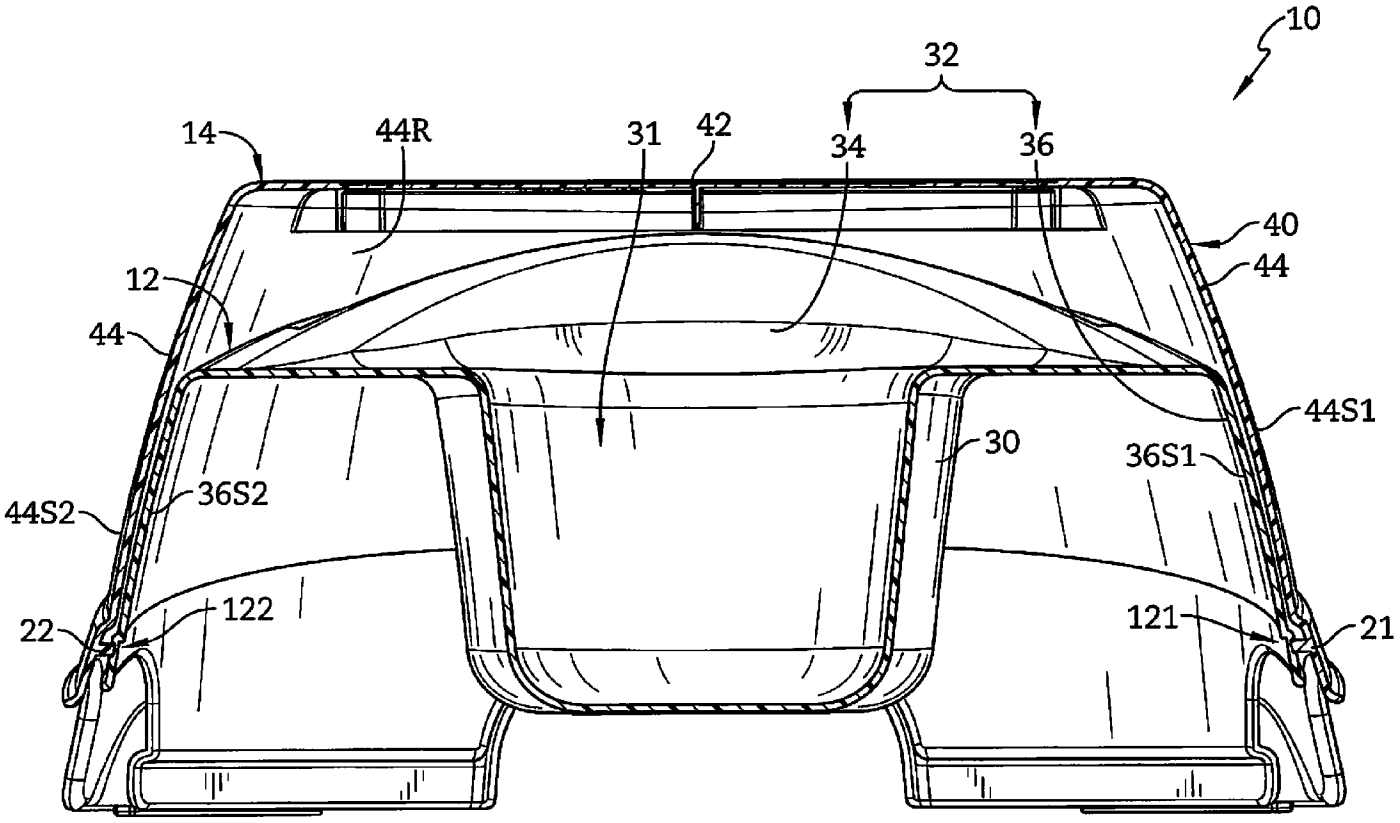
FIG. 5 is an enlarged sectional view of the assembled juvenile bathroom system in accordance with the present disclosure taken along line 5-5 of FIG. 2 showing (on the right) that the first potty-retainer tab of the footstool is inserted into the companion first tab-receiver channel formed in the child potty and (on the left) that the second potty-retainer tab of the footstool is inserted into the companion second tab-receiver channel formed in the child potty so that the footstool is anchored to the child potty.

Child potty anchor lock 18 comprises a first potty-retainer tab 21 that is included in footstool 14 and arranged to engage a companion first tab-receiver channel 121 formed in child potty 12 to retain child potty 12 in a stationary position in potty-storage chamber 16 of footstool 14 as suggested in FIGS. 4 and 5. In illustrative embodiments, child potty anchor lock 18 also includes a second potty-retainer tab 22 that is also included in footstool 14 and arranged to engage a companion second tab-receiver channel 122 also formed in child potty 12 as suggested in FIGS. 4 and 5.

Figure 2:
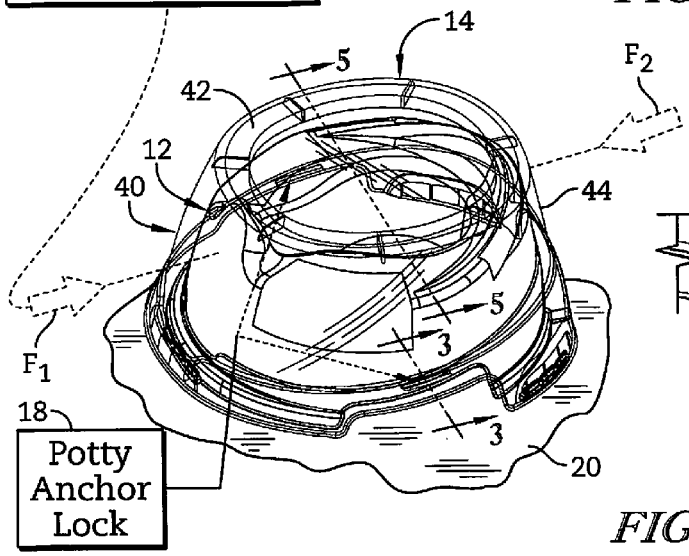
FIG. 2 is a perspective view of an assembled juvenile bathroom system in accordance with the present disclosure showing that the footstool includes a shell that is made of a deformable transparent plastics material so that the child potty is visible when it is retained in the potty-storage chamber formed in the shell of the footstool and suggesting that the footstool is at rest in a stable and stationary position on a floor while the child potty is stored inside.
Figure 3:
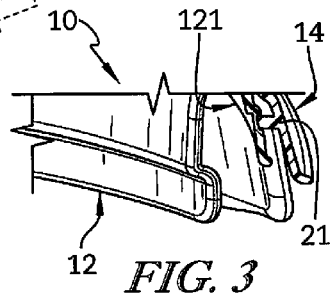
FIG. 3 is an enlarged sectional view taken along line 3-3 of FIG. 2 showing that the footstool also includes a first potty-retainer tab that is cantilevered to an interior surface of a right-side portion of the side wall of the shell and arranged to extend inwardly into a companion first tab-receiver channel formed in the child potty when the child potty is stored in the potty-storage chamber formed in the shell of the footstool so that the footstool is releasably anchored to the child potty.
Figure 6:
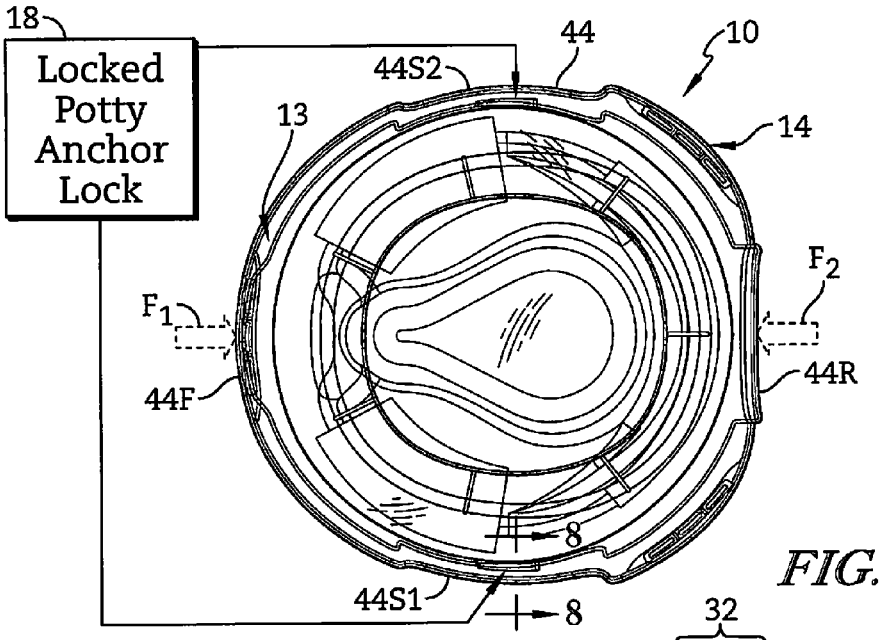
FIG. 6 is a top plan view of the assembled juvenile bathroom system of FIGS. 2 and 5 showing a front side portion of the shell side wall on the left and a rear side portion of the shell side wall on the right.
Figure 7:
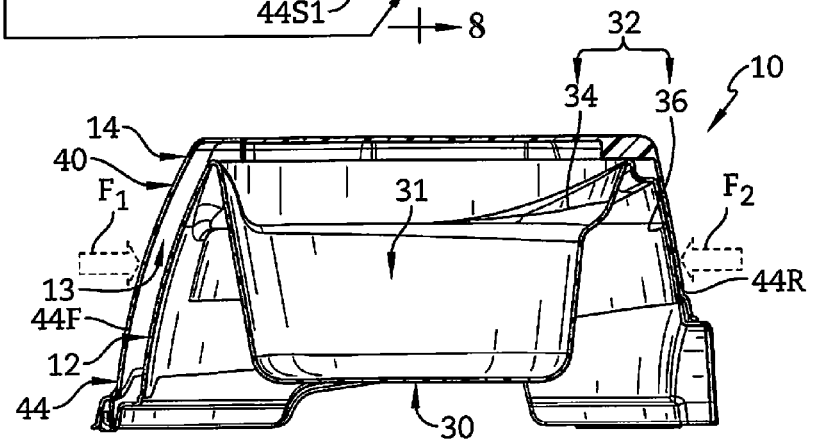
FIG. 7 is a side elevation view of the assembled juvenile bathroom system of FIG. 6 showing the child potty inside the footstool and showing that a space is provided (on the left) between an undeformed (i.e., unsqueezed) front side portion of the side wall of the footstool shell and a companion front side portion of the side wall of the child potty while (on the right) no space is provided between the rear side portion of the side wall of the footstool shell and a companion rear side portion of the side wall of the child potty.
Figure 8:
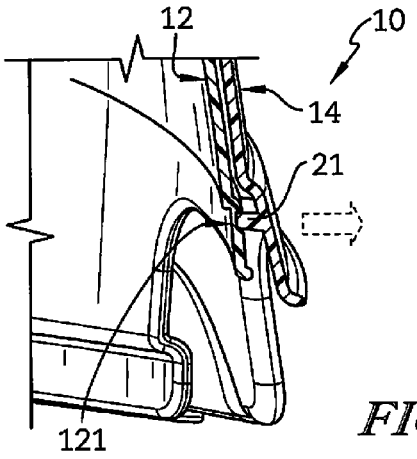
FIG. 8 is an enlarged perspective view similar to FIG. 3 showing that the footstool is anchored to the child potty owing, in part, to insertion of the first potty-retainer tab of the footstool into the first tab-receiver channel of the child potty.

Footstool 14 is made of an elastic deformable material that can be squeezed by a caregiver to unlock child potty anchor lock 18 and illustrative squeezing forces are represented diagrammatically by opposing double arrows F1 and F2 in FIGS. 2, 6, and 8. These squeezing forces F1, F2 are applied to a side wall 44 of footstool 14 while child potty 12 is stored in the stationary position in the potty-storage chamber 16 formed in footstool 14 to deform portions of the footstool 14 so that it changes shape from (1) a normal undeformed first shape shown in FIGS. 2, 6, and 7 in which the first potty-retainer tab 21 extends into the first tab-receiver channel 121 as suggested in FIG. 8 and the second potty-retainer tab 22 extends into the second tab-retainer channel 122 to anchor the child potty 12 in a locked position in the footstool 14 to (2) a temporarily deformed second shape shown in FIGS. 9 and 10 in which the first potty-retainer tab 21 is withdrawn from the first tab-receiver channel 121 (as suggested in FIG. 11) and the second potty-retainer tab 22 is withdrawn from the second tab-retainer channel 122 to free the child potty 12 to be separated from the footstool 14 and removed from the potty-storage chamber 16 formed in the footstool 14.

Child potty 12 includes a waste-collection bowl 30 and a bowl-support frame 32 coupled to bowl 30 and arranged to support bowl 30 in an elevated position above the underlying floor 20 as suggested in FIG. 1. Waste-collection bowl 30 is formed to include an upwardly opening waste-collection chamber 31. Bowl-support frame 32 is formed to include the first and second tab-receiver channels 121, 122 of child potty anchor lock 18 as suggested in FIG. 4. Bowl-support frame 32 may have any suitable size and shape.

Footstool 14 includes a shell 40 that is formed to include the downwardly opening potty-storage chamber 16 as suggested in FIGS. 1 and 4. Footstool 14 also includes the first and second potty-retainer tabs 21, 22 of the child potty anchor lock 18 as suggested in FIG. 4. In illustrative embodiments, each potty-retainer tab 21, 22 is cantilevered to an inner surface of shell 40 and arranged to extend into a companion tab-retainer channel 121, 122 formed in bowl-support frame 32 of child potty 12 to retain child potty 12 in a stationary position in potty-storage chamber 16 of footstool 14 as suggested in FIG. 5.

Bowl-support frame 32 of child potty 12 includes a ring-shaped seat pad 34 adapted to seat a child using child potty 12 and a pad-support rim 36 arranged to elevate seat pad 34 above the floor 20 underlying child potty 12 as suggested in FIG. 4. Pad-support rim 36 is formed to include the first and second tab-receiver channels 121, 122. It is within the scope of the present disclosure to provide pad-support rim 36 with any suitable size and shape.

Shell 40 of footstool 14 includes a horizontal child-support platform 42 on which a child may stand and a platform-elevation side wall 44 for elevating the child-support platform 42 above the floor 20 underlying footstool 14 as suggested in FIGS. 2 and 5. Platform-elevation side wall 44 is configured to carry the first and second potty-retainer tabs 21, 22. It is within the scope of the present disclosure to provide platform-elevation side wall 44 with any suitable size and shape.

Child potty 12 is formed to include a waste-collection chamber 31 and adapted to set on a floor 20 as suggested in FIG. 4 away from a toilet (not shown). Footstool 14 includes a shell 40 formed to include a downwardly opening potty-storage chamber 16 sized to receive substantially all of child potty 12 therein and adapted to set on a floor 20 when child potty 12 is stored in potty-storage chamber 16 as suggested in FIG. 2. Footstool 14 includes a first potty-retainer tab 21 coupled to shell 40 and arranged to extend into a first tab-receiver channel 121 formed in child potty 12 when child potty 12 is stored in potty-storage chamber 16 to retain child potty 12 in a stationary position in potty-storage chamber 16 formed in shell 40 of footstool 14 without impeding use of footstool 14 to elevate children or caregivers above floor 20 as suggested in FIGS. 2, 5, and 10.

Child potty 12 includes a waste-collection bowl 30 formed to include waste-collection chamber 31 and a bowl-support frame 32 coupled to waste-collection bowl 30 as suggested in FIGS. 1 and 4. Bowl-support frame 32 is arranged to extend around waste-collection chamber 31 and formed to include first tab-receiver channel 121.

Bowl-support frame 32 includes a seat pad 34 coupled to waste-collection bowl 30 and arranged to extend around a top aperture 30A opening into the waste-collection chamber 31 formed in waste-collection bowl 30 as suggested in FIGS. 1 and 4. Bowl-support frame 32 also includes a pad-support rim 36 arranged to elevate seat pad 34 above a floor 20 underlying child potty 12 to locate waste-collection bowl 30 therebetween. Pad-support rim 36 is formed to include first tab-receiver channel 121 as suggested in FIG. 4.

Shell 40 includes a horizontal child-support platform 42 arranged to overlie and lie in close proximity to seat pad 34 to cover the top aperture opening into waste-collection chamber 31 when child potty 12 is retained in potty-storage chamber 16 formed in shell 40 as suggested in FIGS. 2 and 7. Shell 40 also includes platform-elevation side wall 44 coupled to child-support platform 42 and arranged to extend downwardly from child-support platform 42 and to surround waste-collection bowl 30. First potty-retainer tab 21 is coupled to platform-elevation side wall 44 and arranged to extend into the first tab-receiver channel 121 formed in bowl-support frame 32 of child potty 12 when child potty 12 is retained in potty-storage chamber 16 formed in footstool 14 as suggested in FIG. 5.

Pad-support rim 36 is made of an elastic deformable material in illustrative embodiments. Pad-support rim 36 has (1) a normal undeformed first shape shown, for example, in FIGS. 4, 5, and 7 in which the first potty-retainer tab 21 carried on pad-support rim 36 is arranged to extend into the first tab-receiver channel 121 formed in bowl-support frame 32 to retain child potty 12 in the stationary position in potty-storage chamber 16 formed in shell 40 of footstool 14 and (2) a temporarily deformed second shape shown, for example, in FIGS. 9 and 10, and generated in response to application of an external squeezing force F1, F2 to pad-support rim 36 in which the first potty-retainer tab 21 carried on pad-support rim 36 is withdrawn from the first tab-receiver channel 121 formed in bowl-support frame 32 to free footstool 14 to be separated from child potty 12.

Child potty 12 further includes a urine deflector 50 coupled to waste-collection bowl 30 and arranged to deflect a stream of urine (not shown) into waste-collection chamber 31 as suggested in FIG. 4. Platform-elevation side wall 44 of shell 40 of footstool 14 includes a front side portion 44F aligned in confronting registry with urine deflector 50 and arranged to lie in spaced-apart relation to a front face 36F of pad-support rim 36 to define a gap 13 therebetween when platform-elevation side wall 44 assumes the normal undeformed shape as shown, for example, in FIGS. 6 and 7. Platform-elevation side wall 44 also includes a rear side portion 44R arranged to lie in spaced-apart relation to the front side portion 44F to locate waste-collection bowl 30 therebetween and in closely confronting relation to a rear face 36R of pad-support rim 36 as suggested in FIGS. 6 and 7. A first side portion 44S1 of platform-elevation side wall 44 is arranged to extend between the front and rear side portions 44F, 44R and configured to have an inner surface facing toward a first side face 36S1 of pad-support rim 36. The first side face 36S1 of pad-support rim 36 is formed to include the first tab-receiver channel 121 as suggested in FIGS. 4 and 5. First potty-retainer tab 21 is coupled to the inner surface of the first side portion 44S1 of platform-elevation side wall 44 of footstool 14 to move therewith to withdraw first potty-retainer tab 21 from first tab-receiver channel 121 during elastic deformation of platform-elevation side wall 44 to change platform-elevation side wall 44 from the normal undeformed first shape shown, for example, in FIGS. 6-8 to the temporarily deformed second shape shown, for example, in FIGS. 9-11.

Platform-elevation side wall 44 of shell 40 of footstool 14 further includes a second side portion 44S2 arranged to extend between the front and rear side portions 44F, 44R and lie in spaced-apart relation to a second side face 36S2 of pad-support rim 36 to locate the waste-collection bowl 30 therebetween. Second side face 36S2 is formed to include a second tab-receiver channel 122. Footstool 14 further includes a second potty-retainer tab 22 arranged to extend into the second tab-receiver channel 122 formed in the second side face 36S2 of pad-support rim to retain child potty 12 in the stationary position in potty-storage chamber 16 formed in shell 40 of footstool 14 when platform-elevation side wall 44 is arranged to assume the normal undeformed shape. Second potty-retainer tab 22 is coupled to an inner surface of the second side portion 44S2 of platform-elevation side wall 44 of shell 40 to move therewith to withdraw second potty-retainer tab 22 from second tab-receiver channel 122 during elastic deformation of platform-elevation side wall 44 to change platform-elevation side wall 44 from the normal undeformed first shape shown, for example, in FIGS. 6-8, to the temporarily deformed second shape shown, for example, in FIGS. 9-11.

Shell 40 of footstool 14 is made of a transparent material as suggested in FIGS. 1 and 2 to provide means for viewing an orientation of child potty 12 retained in potty-storage chamber 16 formed in shell 40 without inverting shell 40 of footstool 14 to peer into the potty-storage chamber 16 formed therein through a bottom aperture opening into potty-storage chamber 16. Shell 40 is made of a deformable transparent plastics material so that child potty 12 is visible when it is retained in potty-storage chamber 16 formed in shell 40 of footstool 14. Footstool 14 is at rest in a stable and stationary position on a floor 20 while child potty 12 is stored inside as suggested in FIG. 2.

An assembled juvenile bathroom system 10 in which child potty 12 is stored and retained in the potty-storage chamber 16 formed in footstool 14 is shown, for example, in FIGS. 6-8. As suggested in FIG. 7, in an illustrative embodiment, a space or gap is provided on the left between an undeformed (i.e., unsqueezed) front side portion 44F of platform-elevation side wall 44 of the footstool shell 40 and a companion front side portion 36F of the side wall of child potty 12 while, on the right, no significant space is provided between the rear side portion 44R of platform-elevation side wall 44 of footstool shell 40 and a companion rear side portion 36R of the side wall 36 of child potty 12. As suggested in FIG. 8, footstool 14 is anchored to child potty 12 owing, in part, to insertion of the first potty-retainer tab 21 of footstool 14 into first tab-receiver channel 121 of child potty 12.

In illustrative embodiments, shell side wall 44 includes a right side portion 44S1 extending between the front and rear side portions 44F, 44R and carrying a right-side potty-retainer tab 21 and a left side portion 44S2 also extending between the front and rear side portions 44F, 44R to lie in laterally spaced-apart relation to the right side portion 44S1 and carrying a left-side potty-retainer tab 22. When the caregiver applies a squeezing force F1, F2 to the front and rear side portions 44F, 44R, as suggested in FIGS. 9 and 10, the front side portion 44F is moved inwardly toward child potty 12 and shell side wall 44 is deformed and changes shape to cause the left side and right side portions 44S1, 44S2 to move away from one another and from the child potty 12 located therebetween to cause (1) a first potty-retainer tab 21 cantilevered to the right side portion 44S1 to disengage a companion first tab-receiver channel 121 formed in one side of child potty 12 and to cause (2) a second potty-retainer tab 22 coupled to the left side portion 44S2 to disengage a companion second tab-receiver channel 122 formed in a second side of child potty 12 to release child potty 12 so that it can be removed from potty-storage chamber 16 formed in footstool 14.

Figure 9:
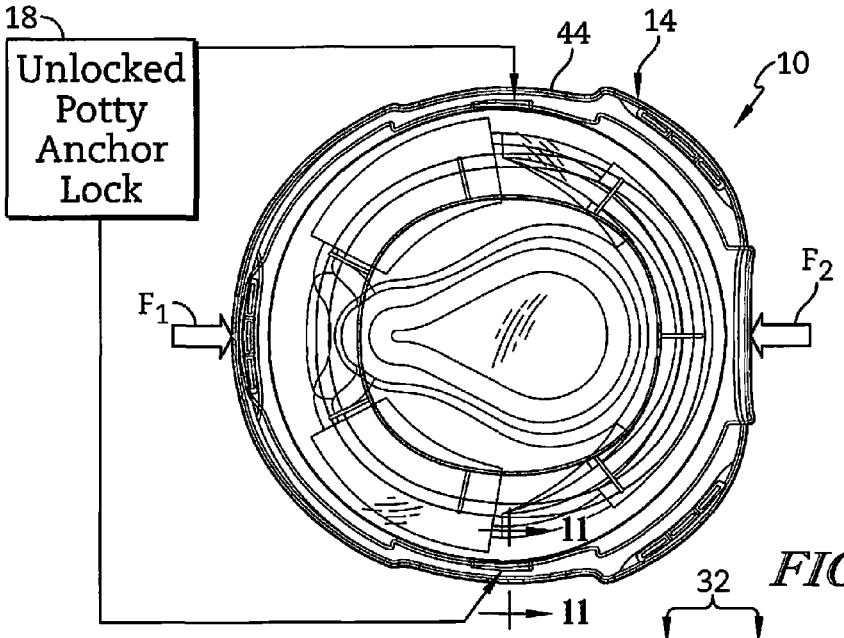
FIG. 9 is a top plan view similar to FIG. 6 suggesting that a caregiver can apply a squeezing pressure (represented by two double arrows) to front and rear side portions of the side wall of the footstool shell to release the footstool from the child potty.
Figure 10:
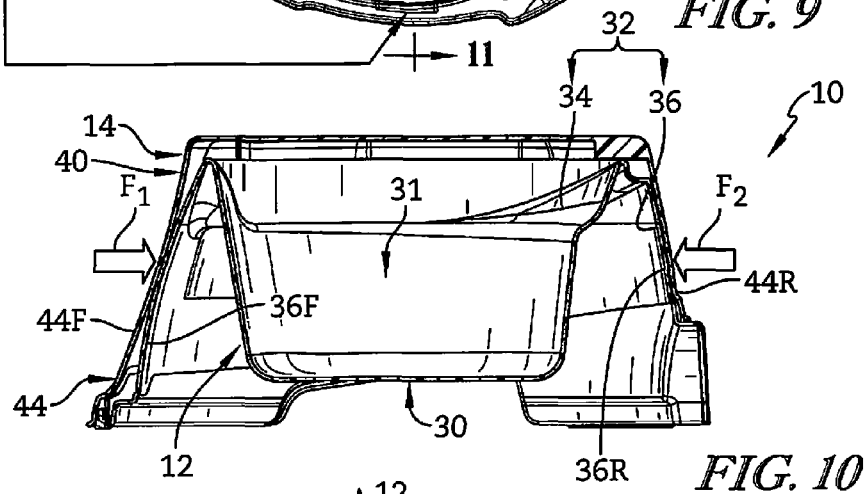
FIG. 10 is a side elevation view of the squeezed juvenile bathroom system of FIG. 9 showing deformation of the front side portion of the side wall of the footstool shell in response to the squeezing pressure applied by a caregiver to front and rear side portions of the side wall of the footstool shell which causes a flexure of left and right portions of the side wall of the footstool shell and movement of those left and right side portions in opposite directions away from the child potty.
Figure 11:
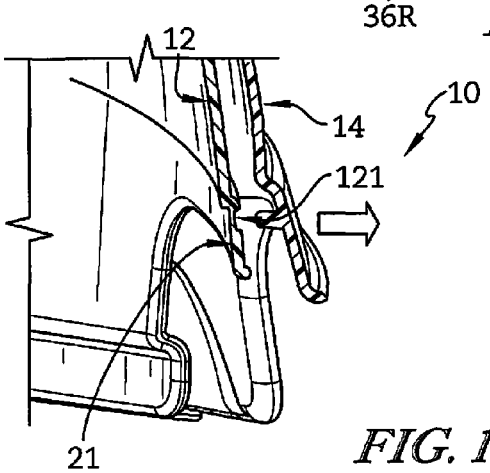
FIG. 11 is a view similar to FIG. 8 showing that flexure of the right side portion of the side wall of the footstool shell causes that right side portion to move away from the child potty to withdraw the first potty-retainer tab of the footstool from the companion first tab-receiver channel formed in the child potty.

A caregiver can apply a squeezing pressure (represented by two double arrows F1, F2) to front and rear side portions 44F, 44R of side wall 44 of footstool shell 40, as suggested in FIGS. 2, 9, and 10 to release footstool 14 from child potty 12. Deformation of the front side portion 44F of the side wall 44 of the footstool shell 40 occurs as suggested in FIGS. 9 and 10 in response to the squeezing pressure F1, F2 applied by a caregiver to front and rear side portions 44F, 44R of side wall 44 of footstool shell 40 which causes a flexure of left and right side portions 44S1, 44S2 of side wall 44 of footstool shell 40 and movement of those left and right side portions 44S1, 44S2 in opposite directions away from child potty 12 as shown, for example, in FIG. 10. As suggested in FIG. 11, flexure of the right side portion 44S1 of side wall 44 of footstool shell 40 causes that right side portion 44S1 to move away from child potty 12 to withdraw first potty-retainer tab 21 of footstool 14 from the companion first tab-receiver channel 121 formed in child potty 12 as suggested in FIG. 11. The inward movement of front and rear side portions 44F, 44R of the deformable platform-elevation side wall 44 of shell 40 of footstool 14 toward one another in response to application of external squeezing forces F1, F2 causes outward movement of first and second side portions 44S1, 44S2 of the deformable platform-elevation side wall 44 away from one another to cause separation of first potty-retainer tab 21 of footstool 14 from companion first tab-retainer channel 121 of child potty 12 and separation of second potty-retainer tab 22 of footstool 14 from companion second tab-receiver channel 122 of child potty 12. This tab-separation step in response to application of squeezing forces F1, F2 to footstool 14 by a caregiver initiates removal of child potty 12 from potty-storage chamber 16 formed in footstool 14.

In illustrative embodiments, three feet 101, 102, 103 are included in footstool 14 and coupled to shell 40 as suggested in FIG. 4. These feet 101, 102, 103 rest on floor 20 when footstool 14 is placed on an underlying floor 20, whether or not a child potty 12 is retained in the potty-storage chamber 16 formed in footstool 14.

The invention claimed is:

1. A juvenile bathroom system comprising a child potty formed to include a waste-collection chamber and adapted to be set on a floor away from a toilet and a footstool including a shell formed to include a downwardly opening potty-storage chamber sized to receive the child potty therein and adapted to be set on the floor when the child potty is stored in the potty-storage chamber and a first potty-retainer tab coupled to the shell and arranged to extend in a radially inward direction into a first tab-receiver channel formed in the child potty when the child potty is stored in the potty-storage chamber to retain the child potty in a stationary position in the potty-storage chamber without impeding use of the footstool to elevate children or caregivers above the floor, wherein the child potty is configured to be set on the floor and used when not received in the footstool, wherein the child potty includes a waste-collection bowl formed to include the waste-collection chamber and a bowl-support frame coupled to the waste-collection bowl and arranged to extend around the waste-collection chamber and support the waste-collection chamber in spaced-apart relation to the floor when the child potty is set on the floor.

2. The juvenile bathroom system of claim 1, wherein the bowl-support frame is formed to include the first tab-receiver channel.

3. The juvenile bathroom system of claim 2, wherein the bowl-support frame includes a seat pad coupled to the waste-collection bowl and arranged to extend around a top aperture that opens into the waste-collection chamber formed in the waste-collection bowl and a pad-support rim arranged to elevate the seat pad above the floor underlying the child potty to locate the waste-collection bowl between the seat pad and the floor and the pad-support rim is formed to include the first tab-receiver channel.

4. The juvenile bathroom system of claim 3, wherein the shell includes a horizontal child-support platform arranged to overlie and lie in proximity to the seat pad to cover the top aperture that opens into the waste-collection chamber when the child potty is retained in the potty-storage chamber formed in the shell and a platform-elevation side wall coupled to the child-support platform and arranged to extend downwardly from the child-support platform and to surround the waste-collection bowl and the first potty-retainer tab is coupled to the platform-elevation side wall and arranged to extend into the first tab-receiver channel formed in the bowl-support frame of the child potty when the child potty is retained in the potty-storage chamber.

5. The juvenile bathroom system of claim 2, wherein the shell includes a horizontal child-support platform arranged to cover the waste-collection chamber when the child potty is retained in the potty-storage chamber formed in the shell and a platform-elevation side wall arranged to surround the waste-collection bowl and the first potty-retainer tab is coupled to the platform-elevation side wall.

6. The juvenile bathroom system of claim 5, wherein the bowl-support frame is formed to include a second tab-receiver channel and the footstool includes a second potty-retainer tab coupled to the shell and arranged to extend into the second tab-receiver channel formed in the bowl-support frame when the child potty is stored in the potty-storage chamber to retain the child potty in the stationary position.

7. The juvenile bathroom system of claim 6, wherein the shell includes an inner surface facing toward the child potty when the child potty is retained in the potty-storage chamber formed in the shell and each of the first and second potty-retainer tabs is cantilevered to the inner surface of the shell and arranged to extend inwardly toward the child potty.

8. The juvenile bathroom system of claim 7, wherein each of the first and second potty-retainer tabs extends along a common reference line.

9. The juvenile bathroom system of claim 5, wherein the shell of the footstool is made of a transparent material to provide means for viewing an orientation of the child potty retained in the potty-storage chamber formed in the shell without inverting the shell of the footstool to peer into the potty-storage chamber formed therein through a bottom aperture that opens into the potty-storage chamber.

10. The juvenile bathroom system of claim 1, wherein the shell includes a horizontal child-support platform arranged to cover the waste-collection chamber when the child potty is retained in the potty-storage chamber formed in the shell and a platform-elevation side wall arranged to surround the waste-collection chamber and the first potty-retainer tab is coupled to the platform-elevation side wall.

11. The juvenile bathroom system of claim 1, wherein the child potty is formed to include a second tab-receiver channel and the footstool includes a second potty-retainer tab coupled to the shell and arranged to extend into the second tab-receiver channel formed in the child potty when the child potty is stored in the potty-storage chamber to retain the child potty in the stationary position.

12. A juvenile bathroom system comprising a child potty formed to include a waste-collection chamber and adapted to be set on a floor away from a toilet and a footstool including a shell formed to include a downwardly opening potty-storage chamber sized to receive of the child potty therein and adapted to be set on the floor when the child potty is stored in the potty-storage chamber and a first potty-retainer tab coupled to the shell and arranged to extend into a first tab-receiver channel formed in the child potty when the child potty is stored in the potty-storage chamber to retain the child potty in a stationary position in the potty-storage chamber without impeding use of the footstool to elevate children or caregivers above the floor, wherein the child potty includes a waste-collection bowl formed to include the waste-collection chamber and a bowl-support frame coupled to the waste-collection bowl and arranged to extend around the waste-collection chamber and the bowl-support frame is formed to include the first tab-receiver channel, wherein the bowl-support frame includes a seat pad coupled to the waste-collection bowl and arranged to extend around a top aperture that opens into the waste-collection chamber formed in the waste-collection bowl and a pad-support rim arranged to elevate the seat pad above the floor underlying the child potty to locate the waste-collection bowl between the seat pad and the floor and the pad-support rim is formed to include the first tab-receiver channel, wherein the shell includes a horizontal child-support platform arranged to overlie and lie in proximity to the seat pad to cover the top aperture that opens into the waste-collection chamber when the child potty is retained in the potty-storage chamber formed in the shell and a platform-elevation side wall coupled to the child-support platform and arranged to extend downwardly from the child-support platform and to surround the waste-collection bowl and the first potty-retainer tab is coupled to the platform-elevation side wall and arranged to extend into the first tab-receiver channel formed in the bowl-support frame of the child potty when the child potty is retained in the potty-storage chamber formed in the footstool, wherein the child potty is adapted to be set on the floor and used when not received in the footstool, and wherein the platform-elevation side wall is made of an elastic deformable material having an undeformed first shape in which the first potty-retainer tab carried on the platform-elevation side wall is arranged to extend into the first tab-receiver channel formed in the bowl-support frame to retain the child potty in the stationary position in the potty-storage chamber and a temporarily deformed second shape generated in response to application of an external squeezing force to the platform-elevation side wall in which the first potty-retainer tab carried on the platform-elevation side wall is withdrawn from the first tab-receiver channel formed in the bowl-support frame to free the footstool to be separated from the child potty.

13. A juvenile bathroom system comprising a child potty formed to include a waste-collection chamber and adapted to be set on a floor away from a toilet and a footstool including a shell formed to include a downwardly opening potty-storage chamber sized to receive the child potty therein and adapted to be set on the floor when the child potty is stored in the potty-storage chamber and a first potty-retainer tab coupled to the shell and arranged to extend into a first tab-receiver channel formed in the child potty when the child potty is stored in the potty-storage chamber to retain the child potty in a stationary position in the potty-storage chamber without impeding use of the footstool to elevate children or caregivers above the floor wherein the child potty includes a waste-collection bowl formed to include the waste-collection chamber and a bowl-support frame coupled to the waste-collection bowl and arranged to extend around the waste-collection chamber and the bowl-support frame is formed to include the first tab-receiver channel, wherein the bowl-support frame includes a seat pad coupled to the waste-collection bowl and arranged to extend around a top aperture that opens into the waste-collection chamber formed in the waste-collection bowl and a pad-support rim arranged to elevate the seat pad above the floor underlying the child potty to locate the waste-collection bowl between the seat pad and the floor and the pad-support rim is formed to include the first tab-receiver channel, wherein the shell includes a horizontal child-support platform arranged to overlie and lie in proximity to the seat pad to cover the top aperture that opens into the waste-collection chamber when the child potty is retained in the potty-storage chamber formed in the shell and a platform-elevation side wall coupled to the child-support platform and arranged to extend downwardly from the child-support platform and to surround the waste-collection bowl and the first potty-retainer tab is coupled to the platform-elevation side wall and arranged to extend into the first tab-receiver channel formed in the bowl-support frame of the child potty when the child potty is retained in the potty-storage chamber formed in the footstool, wherein the platform-elevation side wall is made of an elastic deformable material having an undeformed first shape in which the first potty-retainer tab carried on the platform-elevation side wall is arranged to extend into the first tab-receiver channel formed in the bowl-support frame to retain the child potty in the stationary position in the potty-storage chamber and a temporarily deformed second shape generated in response to application of an external squeezing force to the platform-elevation side wall in which the first potty-retainer tab carried on the platform-elevation side wall is withdrawn from the first tab-receiver channel formed in the bowl-support frame to free the footstool to be separated from the child potty, and wherein the child potty further includes a urine deflector coupled to the waste-collection bowl and arranged to deflect a stream of urine into the waste-collection chamber, the platform-elevation side wall of the shell of the footstool includes a front side portion aligned in confronting registry with the urine deflector and arranged to lie in spaced-apart relation to a front face of the pad-support rim to define a gap therebetween when the platform-elevation side wall assumes the undeformed shape, a rear side portion arranged to lie in spaced-apart relation to the front side portion to locate the waste-collection bowl therebetween and in confronting relation to a rear face of the pad-support rim, and a first side portion arranged to extend between the front and rear side portions and configured to have an inner surface facing toward a first side face of the pad-support rim, the first side face of the pad-support rim is formed to include the first tab-receiver channel, and the first potty-retainer tab is coupled to the inner surface of the first side portion of the platform-elevation side wall of the footstool to move therewith to withdraw the first potty-retainer tab from the first tab-receiver channel during elastic deformation of the platform-elevation side wall to change the platform-elevation side wall from the undeformed first shape to the temporarily deformed second shape.

14. The juvenile bathroom system of claim 13, wherein the platform-elevation side wall of the shell of the footstool further includes a second side portion arranged to extend between the front and rear side portions and lie in spaced-apart relation to a second side face of the pad-support rim to locate the waste-collection bowl between the front side portion, the rear side portion and the second side portion, the second side face is formed to include a second tab-receiver channel, and the footstool further includes a second potty-retainer tab arranged to extend into the second tab-receiver channel formed in the second side face of the pad-support rim to retain the child potty in the stationary position in the potty-storage chamber when the platform-elevation side wall is arranged to assume the undeformed shape, and the second potty-retainer tab is coupled to an inner surface of the second side portion of the platform-elevation side wall of the shell to move therewith to withdraw the second potty-retainer tab from the second tab-receiver channel during elastic deformation of the platform-elevation side wall to change the platform-elevation side wall from the undeformed first shape to the temporarily deformed second shape.

15. The juvenile bathroom system of claim 13, wherein the shell of the footstool is made of a transparent material to provide means for viewing an orientation of the child potty retained in the potty-storage chamber formed in the shell without inverting the shell of the footstool to peer into the potty-storage chamber formed therein through a bottom aperture that opens into the potty-storage chamber.

16. A juvenile bathroom system comprising a child potty formed to include a waste-collection chamber and adapted to be set on a floor away from a toilet and a footstool including a shell formed to include a downwardly opening potty-storage chamber sized to receive the child potty therein and adapted to be set on the floor when the child potty is stored in the potty-storage chamber and a first potty-retainer tab coupled to the shell and arranged to extend into a first tab-receiver channel formed in the child potty when the child potty is stored in the potty-storage chamber to retain the child potty in a stationary position in the potty-storage chamber without impeding use of the footstool to elevate children or caregivers above the floor, wherein the child potty is adapted to be set on the floor and used when not received in the footstool, wherein the child potty includes a waste-collection bowl formed to include the waste-collection chamber and a bowl-support frame coupled to the waste-collection bowl and arranged to extend around the waste-collection chamber and the bowl-support frame is formed to include the first tab-receiver channel, wherein the shell includes a horizontal child-support platform arranged to cover the waste-collection chamber when the child potty is retained in the potty-storage chamber formed in the shell and a platform-elevation side wall arranged to surround the waste-collection bowl and the first potty-retainer tab is coupled to the platform-elevation side wall, and wherein the platform-elevation side wall is made of an elastic deformable material having an undeformed shape in which the first potty-retainer tab carried on the platform-elevation side wall is arranged to extend into the first retainer-tab channel to retain the child potty in the stationary position in the potty-storage chamber and a temporarily deformed second shape in which the first potty-retainer tab carried on the platform-elevation side wall is withdrawn from the first tab-receiver to free the footstool to be separated from the child potty.

17. A juvenile bathroom system comprising a child potty formed to include a waste-collection chamber and adapted to be set on a floor away from a toilet and a footstool including a shell formed to include a downwardly opening potty-storage chamber sized to receive the child potty therein and adapted to be set on the floor when the child potty is stored in the potty-storage chamber and a first potty-retainer tab coupled to the shell and arranged to extend into a first tab-receiver channel formed in the child potty when the child potty is stored in the potty-storage chamber to retain the child potty in a stationary position in the potty-storage chamber without impeding use of the footstool to elevate children or caregivers above the floor, wherein the child potty includes a waste-collection bowl formed to include the waste-collection chamber and a bowl-support frame coupled to the waste-collection bowl and arranged to extend around the waste-collection chamber and the bowl-support frame is formed to include the first tab-receiver channel, wherein the shell includes a horizontal child-support platform arranged to cover the waste-collection chamber when the child potty is retained in the potty-storage chamber formed in the shell and a platform-elevation side wall arranged to surround the waste-collection bowl and the first potty-retainer tab is coupled to the platform-elevation side wall, wherein the platform-elevation side wall is made of an elastic deformable material having an undeformed shape in which the first potty-retainer tab carried on the platform-elevation side wall is arranged to extend into the first retainer-tab channel to retain the child potty in the stationary position in the potty-storage chamber and a temporarily deformed second shape in which the first potty-retainer tab carried on the platform-elevation side wall is withdrawn from the first tab-receiver to free the footstool to be separated from the child potty, and wherein the child potty further includes a urine deflector coupled to the waste-collection bowl and arranged to deflect a stream of urine into the waste-collection chamber, the platform-elevation side wall of the shell of the footstool includes a front side portion aligned in confronting registry with the urine deflector and arranged to lie in spaced-apart relation to a front face of a pad-support rim to define a gap therebetween when the platform-elevation side wall assumes the undeformed shape, a rear side portion arranged to lie in spaced-apart relation to the front side portion to locate the waste-collection bowl therebetween and in confronting relation to a rear face of the pad-support rim, and a first side portion arranged to extend between the front and rear side portions and configured to have an inner surface facing toward a first side face of the pad-support rim, the first side face of the pad-support rim is formed to include the first tab-receiver channel, and the first potty-retainer tab is coupled to the inner surface of the first side portion of the platform-elevation side wall of the footstool to move therewith to withdraw the first potty-retainer tab from the first tab-receiver channel during elastic deformation of the platform-elevation side wall to change the platform-elevation side wall from the undeformed first shape to the temporarily deformed second shape.

18. A juvenile bathroom system comprises a child potty adapted to be set on a floor away from a toilet so that it can be used by a young child during toilet training, a footstool adapted to be set on the floor and formed to include a downwardly opening potty-storage chamber that is sized to receive and store the child potty therein during use of the footstool to elevate the child above the floor, wherein the footstool includes a shell formed to include the downwardly opening potty-storage chamber, the shell includes a horizontal child-support platform and a downwardly extending platform-elevation side wall coupled to a perimeter edge of the child-support platform, and the footstool also includes a potty-retainer tab coupled to the shell and arranged to extend in a radially inward direction into a companion tab-receiver channel formed in the child potty when the child potty is deposited into the potty-storage chamber formed in the shell to retain the child potty in a stationary position on the footstool, wherein the child potty is configured to be set on the floor and used when not received in the footstool, wherein the child potty includes a waste-collection bowl formed to include a waste-collection chamber and a bowl-support frame coupled to the waste-collection bowl and arranged to extend around the waste-collection chamber and support the waste-collection chamber in spaced-apart relation to the floor when the child potty is set on the floor.

19. The juvenile bathroom system of claim 18, wherein the platform-elevation side wall of the shell includes an inner surface bounding the potty-storage chamber and surrounding the child potty stored therein and the potty-retainer tab is cantilevered to the inner surface of the platform-elevation side wall of the shell.

20. A juvenile bathroom system comprises a child potty adapted to be set on a floor away from a toilet so that it can be used by a young child during toilet training, a footstool adapted to be set on the floor and formed to include a downwardly opening potty-storage chamber that is sized to receive and store the child potty therein during use of the footstool to elevate the child above the floor, wherein the footstool includes a shell formed to include the downwardly opening potty-storage chamber, the shell includes a horizontal child-support platform and a downwardly extending platform-elevation side wall adapted to be set on the floor and coupled to a perimeter edge of the child-support platform, and the footstool also includes a potty-retainer tab coupled to the shell and arranged to extend into a companion tab-receiver channel formed in the child potty when the child potty is deposited into the potty-storage chamber formed in the shell to retain the child potty in a stationary position in the footstool, wherein the platform-elevation side wall of the shell includes an inner surface bounding the potty-storage chamber and surrounding the child potty stored therein and the potty-retainer tab is cantilevered to the inner surface of the platform-elevation side wall of the shell, wherein the child potty is adapted to be set on the floor and used when not received in the footstool, and wherein the shell is made of an elastic deformable plastics material and a portion of the platform-elevation side wall is arranged to lie in spaced-apart relation to the child potty when the child potty is stored in the potty-storage chamber formed in the shell, the potty-retainer tab is arranged to extend into the companion tab-receiver channel to anchor the footstool to the stored child potty, a side portion of the platform-elevation side wall that carries the potty-retainer tab is configured and arranged to deform in response to application of a squeezing force to opposite front and rear side portions of the platform-elevation side wall by a caregiver to cause the potty-retainer tab to move outwardly away from the child potty to a disengaged position that is withdrawn from the companion tab-receiver channel formed in the child potty to release the child potty from the footstool so that the footstool can be lifted upwardly leaving the child potty in a stationary position on the floor.

21. The juvenile bathroom system of claim 20, wherein the side portion of the platform-elevation side wall includes a right side portion extending between the front and rear side portions and carrying the potty-retainer tab and a left side portion also extending between the front and rear side portions to lie in laterally spaced-apart relation to the right side portion and carrying a left-side potty-retainer tab, the front side portion is moved inwardly toward the child potty and the platform-elevation side wall is deformed and changes shape when the caregiver applies a squeezing force to the front and rear side portions to cause the left side and right side portions to move away from one another and from the child potty located therebetween to cause the potty-retainer tab cantilevered to the right side portion to disengage the companion tab-receiver channel formed in one side of the child potty and to cause the left-side potty-retainer tab coupled to the left side portion to disengage a companion second tab-receiver channel formed in a second side of the child potty to release the child potty so that it can be removed from the potty-storage chamber formed in the footstool.

* * * * *